US009273426B2

(12) United States Patent
Rosa et al.

(10) Patent No.: US 9,273,426 B2
(45) Date of Patent: Mar. 1, 2016

(54) IRONING SYSTEM WITH IRON PROVIDED WITH SUPPLEMENTARY WATER TANK

(71) Applicant: DE'LONGHI APPLIANCES S.R.L. DIVISIONE COMMERCIALE ARIETE, Campi Bisenzio, Province of Florence (IT)

(72) Inventors: Carlo Rosa, Lecco (IT); Michele Picchi, Pontedera (IT)

(73) Assignee: De' Longhi Appliances S.r.l. Divisione Commerciale ARIETE, Campi Bisenzio, Province of Firenze (IT)

( * ) Notice: Subject to any disclaimer, the term of this patent is extended or adjusted under 35 U.S.C. 154(b) by 0 days.

(21) Appl. No.: 14/399,453

(22) PCT Filed: May 8, 2013

(86) PCT No.: PCT/EP2013/059655

§ 371 (c)(1),
(2) Date: Nov. 6, 2014

(87) PCT Pub. No.: WO2013/167692

PCT Pub. Date: Nov. 14, 2013

(65) Prior Publication Data

US 2015/0135562 A1 May 21, 2015

(30) Foreign Application Priority Data

May 10, 2012 (IT) ..... GE2012A0050

(51) Int. Cl.
*D06F 75/12* (2006.01)
*D06F 75/14* (2006.01)
(Continued)

(52) U.S. Cl.
CPC ..... *D06F 75/12* (2013.01); *D06F 75/02* (2013.01); *D06F 75/06* (2013.01); *D06F 75/14* (2013.01); *D06F 75/22* (2013.01); *D06F 75/32* (2013.01); *D06F 75/40* (2013.01)

(58) Field of Classification Search
CPC ..... D06F 75/08; D06F 75/10; D06F 75/12; D06F 75/14; D06F 75/18; D06F 75/22; D06F 75/28; D06F 75/40; B05B 1/00; B05B 11/3002
See application file for complete search history.

(56) References Cited

U.S. PATENT DOCUMENTS 2,700,236 A * 1/1955 Stanley ..... D06F 75/18 38/77.83
2,817,169 A * 12/1957 Schott ..... D06F 75/22 38/77.1

(Continued)

FOREIGN PATENT DOCUMENTS

DE WO2010054995 A1 * 5/2010
EP 2578744 4/2013

(Continued)

OTHER PUBLICATIONS

International Search Report & Written Opinion for International Application No. PCT/EP2013/059655; Jun. 19, 2013; 9 pages.

*Primary Examiner* — Ismael Izaguirre
(74) *Attorney, Agent, or Firm* — Stetina Brunda Garred & Brucker

(57) ABSTRACT

Ironing system comprising a machine body provided with means for producing and supplying steam and an iron comprising a heated soleplate and connected to this machine body by means of a tube for the passage of steam and an electrical cable; this iron comprises a supplementary water tank suitable to supply water to this heated soleplate and at least one control button suitable to cooperate with a switch for operating means for producing and supplying steam from the machine body and with means for pumping water from this supplementary tank to this heated soleplate, in a first active position of this button, these means for producing and supplying the steam from the machine body are operated and, in a second active position of this button these pumping means are operated so as to obtain a further production of steam by means of the passage of this water from this supplementary tank to this heated soleplate.

9 Claims, 4 Drawing Sheets

(51) Int. Cl.

| | |
|---|---|
| ***D06F 75/22*** | (2006.01) |
| ***D06F 75/40*** | (2006.01) |
| ***D06F 75/02*** | (2006.01) |
| ***D06F 75/06*** | (2006.01) |
| ***D06F 75/32*** | (2006.01) |

(56) References Cited

U.S. PATENT DOCUMENTS 3,224,122 A * 12/1965 Ivar ..... D06F 75/14 38/77.2
3,248,813 A * 5/1966 Quick ..... D06F 75/12 239/590
3,986,282 A * 10/1976 Nelson ..... D06F 75/18 38/77.83
5,842,295 A * 12/1998 Ching ..... D06F 75/12 219/246
2002/0157288 A1 10/2002 Valiyambath
2010/0122478 A1 5/2010 Lee
2010/0307034 A1* 12/2010 Knott ..... D06F 75/26 38/77.5
2011/0271565 A1* 11/2011 Ong ..... D06F 75/34 38/77.9

FOREIGN PATENT DOCUMENTS

FR 2523164 A * 9/1983
FR 2853671 10/2004

* cited by examiner

IRONING SYSTEM WITH IRON PROVIDED WITH SUPPLEMENTARY WATER TANK

CROSS REFERENCE TO RELATED APPLICATIONS

The present application claims priority to PCT International Application No. PCT/EP2013/059655 filed on May 8, 2013, which claims priority to Italian Patent Application No. GE2012A000050 filed May 10, 2012, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

The present invention relates to ironing systems.

Conventional ironing systems are essentially composed of an iron and of a machine body which are connected indissolubly and inseparably by means of an electrical cable and a steam tube. The machine body comprises therein steam generation means, for example a boiler, associated with a solenoid valve suitable to enable delivery of steam from said means toward the iron. This solenoid valve is controlled by a switch operable by a button positioned on the box body of the iron and pressed by the user during normal ironing operations. The iron normally has a soleplate provided with holes for output of the steam and an electrical heating element for heating the soleplate. Therefore, in substance in these conventional ironing systems, the iron collects steam only from the steam tube connected to the machine body.

SUMMARY OF THE INVENTION

The object of the present invention is to produce an ironing system with an iron which, besides being supplied with the steam coming from the machine body of the ironing system, can also supply by itself an amount of supplementary steam, in the form of a flow of steam of short duration, known as "steam boost", and/or in the form of a constant flow of steam, and which is also provided with front delivery means of a jet of nebulised water.

This object is achieved by the present invention through an ironing system with iron provided with a supplementary tank according to claim 1.

Other important features of the present invention form the subject matter of the dependent claims.

Therefore, the present iron, due to the use of the supplementary tank and of the button with dual operating mode, can deliver steam separately or in addition to the steam normally delivered by the machine body.

BRIEF DESCRIPTION OF THE DRAWINGS

Further features and advantages of the present invention will be better understood from the following description, to be considered purely by way of non-limiting example and with reference to the accompanying drawings, wherein.

DETAILED DESCRIPTION OF THE INVENTION

Figure 1:
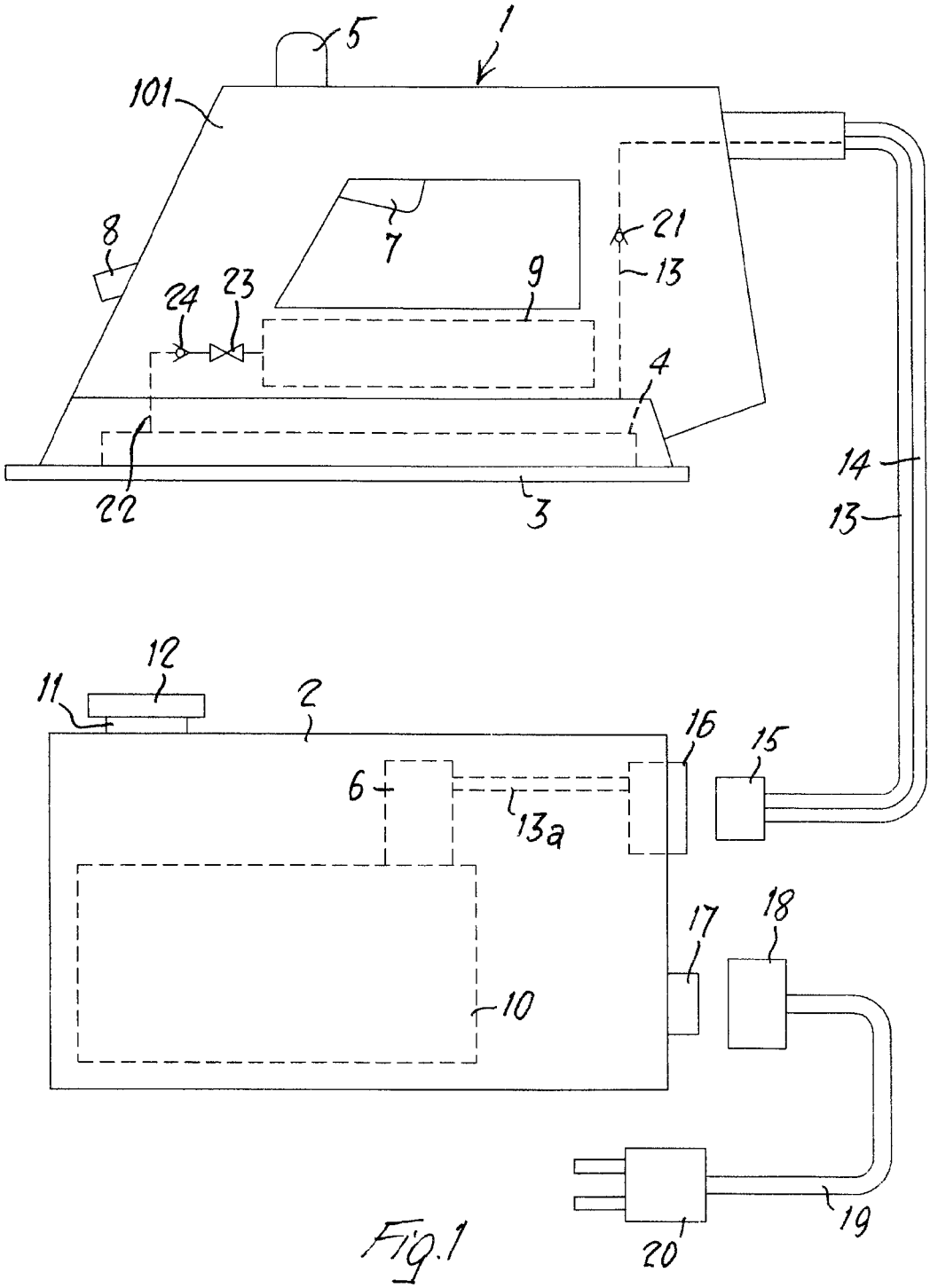
FIG. 1 illustrates a schematic view of an ironing system provided with an iron with supplementary water tank according to the present invention.

With reference to the accompanying drawings and with particular reference to FIG. 1 thereof, the numbers 1 and 2 indicate respectively an iron and a machine body of an ironing system in which the iron 1 is separable from the machine body 2. The iron 1 comprises a box body 101 provided inferiorly with a soleplate 3 for delivering steam bearing a series of small holes, not visible in the figure. Above the soleplate 3 there is positioned a chamber 4 in which there are obtained a series of cavities, known per se, communicating with the steam delivery holes. This soleplate 3 will also be provided with heating means, such as a heating element or the like. From the box body 101 of the iron 1 there projects a first control button 7 of a solenoid valve 6 present in the machine body 2 and a second button 5, suitable to control the emission of jets of nebulised hot water from a sprayer located on the front of the box body 101. Inside the box body 101 of the iron 1 there is also installed a supplementary water tank 9 positioned above the chamber 4 and therefore the soleplate 3. This tank 9 could alternatively be placed above the box body 101 of the iron 1. The machine body 2 comprises therein steam producing means, for example a boiler 10, start-up of which is controlled by the solenoid valve 6. The necessary quantity of water is introduced into this boiler 10 through an opening 11 obtained on the top of the machine body 2 and provided with a cap 12. The iron 1 and the machine body 2 are connectable by means of a tube 13 for sending the steam from the machine body 2 to the iron 1, and by a multicore electrical cable 14, having the object of supplying the iron 1 with the electrical energy necessary for operation, for example to supply the heating means of the soleplate 3 described subsequently and to establish a contact between the button 7 and the solenoid valve 6 of the machine body 2. This tube 13 for sending steam and this electrical cable 14 are connected at one end to a single connection plug 15, suitable to connect with a corresponding socket 16 positioned on an outer wall of the machine body 2. Between the connection socket 16 and the solenoid valve 6 there is provided a portion 13*a* of tube for the passage of steam. On the outer wall of the machine body 2 there is positioned a second connection plug 17 for coupling with a second connection socket 18 positioned at the end of a normal electrical cable 19, bearing a plug 20 for connection to the normal electricity network. The first plug 15 is suitable to connect both with the first socket 16 and also with the second socket 18, so as to exclude the machine body 2 and use only the iron 1. The various electrical contacts of the plugs 15 and 17 and of the sockets 16 and 18 and the means for the passage of steam inside the plug 15 and the socket 16 are described in detail in a patent application relating to an innovative ironing system filed by the holders of the present application simultaneously to this latter. The tube 13 for sending steam that carries steam to the chamber 4 and therefore to the soleplate 3 is illustrated with a broken line inside the box body 101 of the iron 1, and comprises a check valve 21. The supplementary tank 9 is suitable to send the water to the chamber 4 by means of a duct 22 in which there are schematically illustrated a valve 23 for opening the tank and a check valve 24.

The button 7, see section of FIG. 2, comprises: a first arm 107, which is maintained in the rest position illustrated by means of a spring 25; a second arm 207, suitable to engage, in an active position illustrated below, with the rod 26 of a piston of a pump 27; and an appendix 307 that, at rest, is in contact with an actuator 128 of a switch 28. This switch 28 is electrically connected with the solenoid valve 6 of the machine body 2 of FIG. 1 and this actuator 128, by means of the thrust of the appendage 307, maintains this switch 24 in open position. The two arms 107 and 207 of the button 7 are produced integral with each other and, in a substantially central position, this button 7 comprises a pin 29 for rotation with respect to a fixed support element 30 connected to the box body 101 of the iron 1. The pump 27 can collect water from the supplementary tank 9 by means of a first duct 31 and send it to the chamber 4 by means of a second duct 32. The supplementary tank 9 for containing the water can be filled by means of a duct 49 closed at the top by a cap 32. As mentioned previously, this chamber is provided with a series of mutually communicating cavities 104 and there is positioned at the top wall thereof a check valve 21, of the type with seals in elastomeric material and suitable to open only when steam comes from the tube 13 and not in the opposite direction. The soleplate 3 is provided with a series of holes 103 for emission of the steam, one of which is illustrated in the figure in section, and comprises an electrical heating element 33 provided with a coupling 34 for connection with the electrical cable 14.

Figure 2:
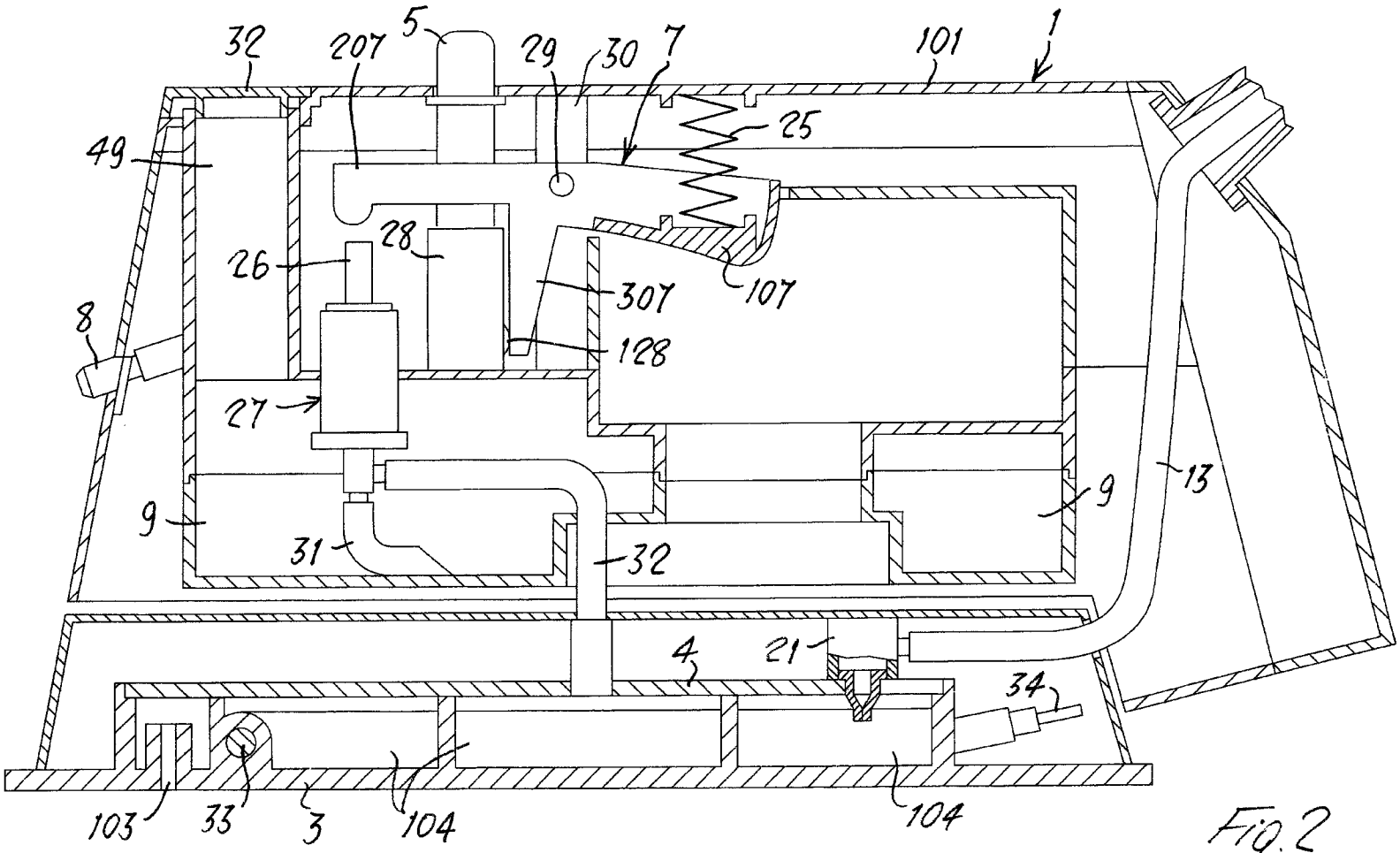
FIG. 2 illustrates a longitudinal sectional view of the iron of FIG. 1.
Figure 3:
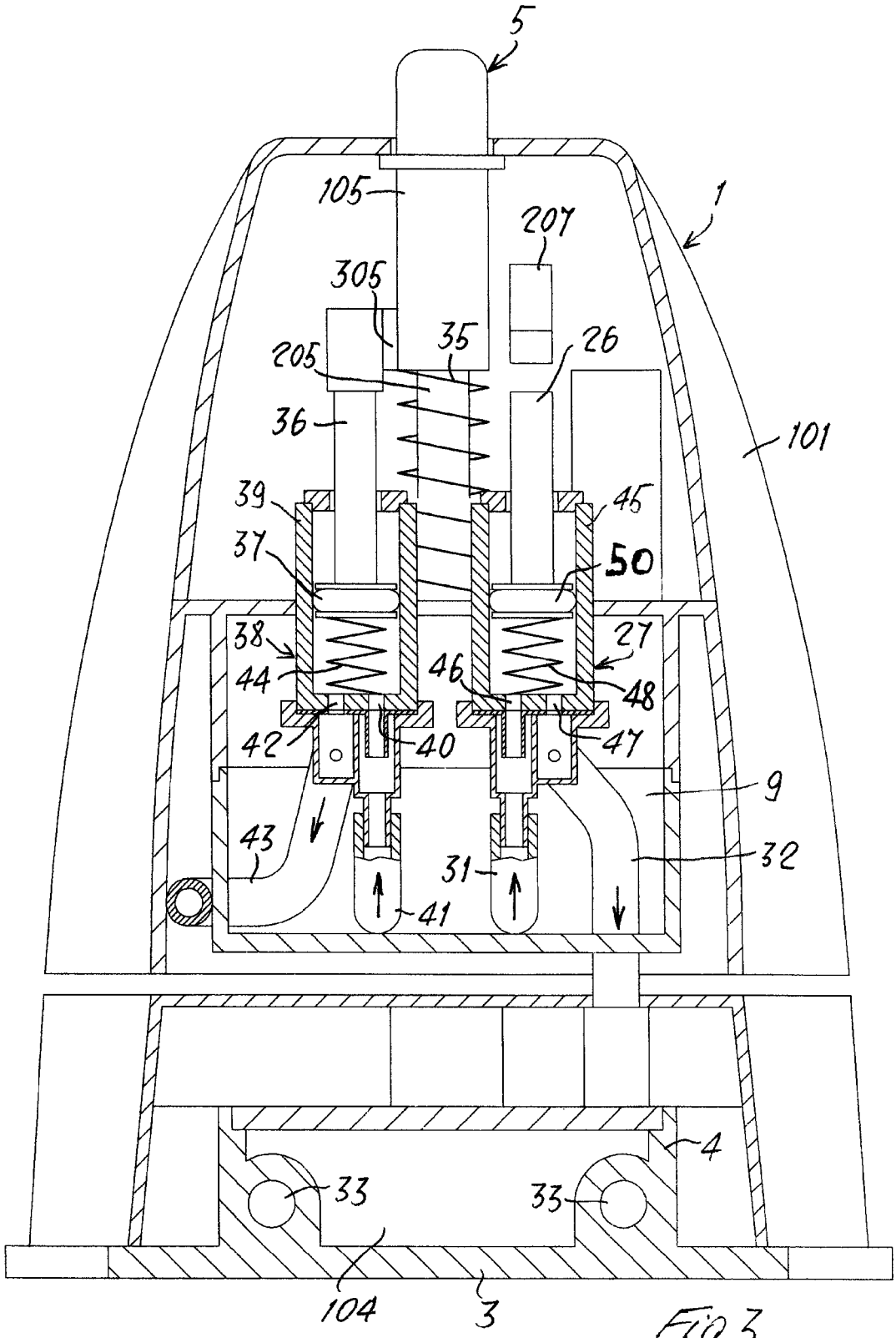
FIG. 3 illustrates a cross sectional view of the iron of FIG. 2.

With reference to FIG. 3, the button 5 for delivering water from the sprayer 8 of FIGS. 1 and 2 comprises an upper tubular element 105 sliding on a lower fixed shaft 205 around which there is wound a spring 35 which maintains the tubular element 105 of the button 5 in the rest position illustrated in the figure. Laterally, the movable tubular element 105 comprises an arm 305 connected with the rod 36 of a piston of a pump 38. This pump 38 enables water to be collected from the supplementary tank 9 and sent to the sprayer and comprises a cylinder 39 in which this piston 37 can slide. This cylinder 39 is provided at the bottom with a first inlet hole 40 communicating with a duct 41 for collecting water from the supplementary tank 9 and a second outlet hole 42 communicating with a duct 43 for sending water to the sprayer 8 of FIGS. 1 and 2. In the cylinder 39 there is provided a spring 44 that maintains the piston 37 in the rest position illustrated in the figure. The pump 27 for collecting water from the tank 9 and sending it to the chamber 4 also comprises a cylinder 45 in which there can slide a piston 50 connected to the rod 26, suitable to be pressed in the active position by the arm 207 of the button 7 of FIG. 2. This cylinder 45 is provided at the bottom with a first inlet hole 46 communicating with the duct 31 for collecting water from the tank 9 and with a second outlet hole 47 communicating with the duct 32 for sending water to the chamber 4. In the cylinder 45 there is provided a spring 48 that maintains the piston 50 in the rest position illustrated in the figure.

Figure 4B:
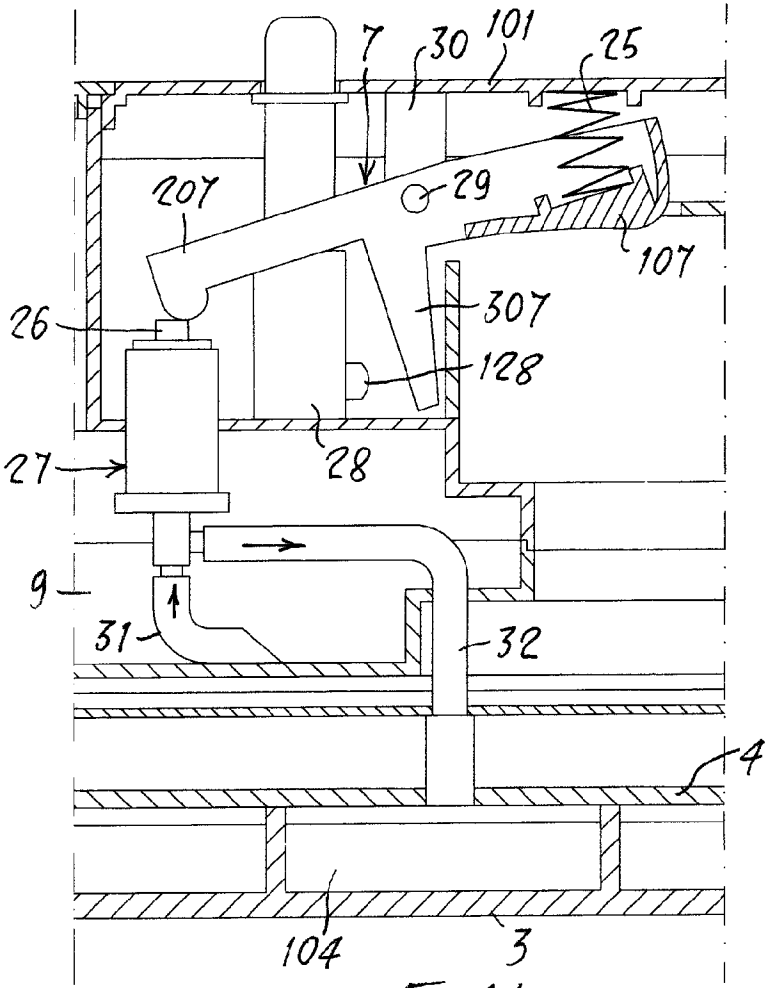
FIG. 4*b* illustrates a second view in enlarged scale and in longitudinal section of the control button in a second operating position for operating a pump to collect water from the supplementary tank.
Figure 4A:
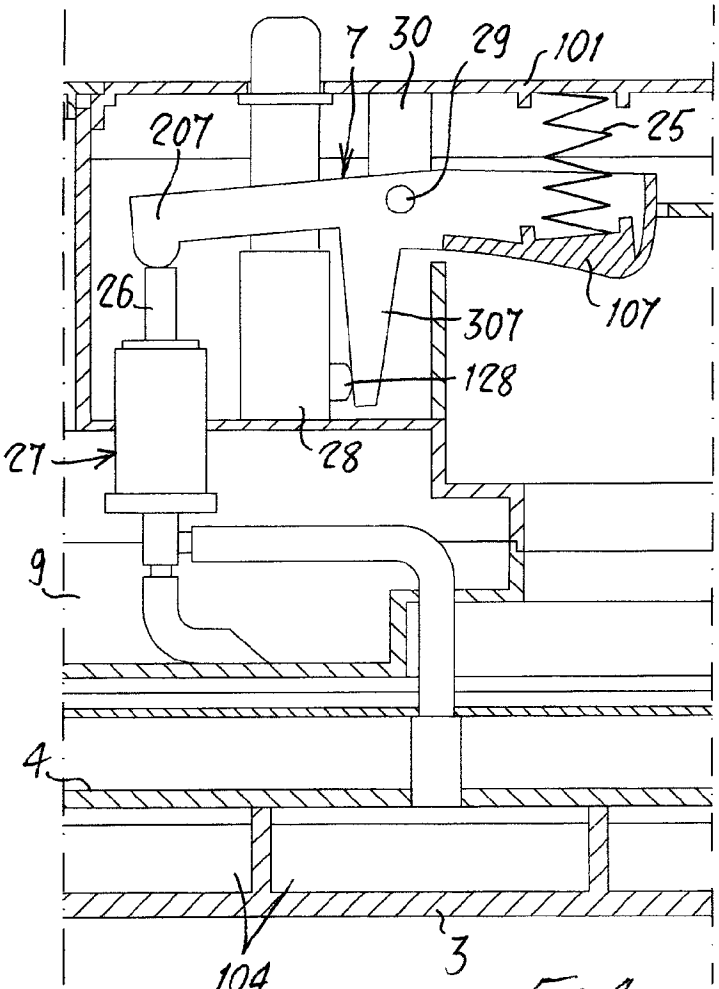
FIG. 4*a* illustrates a first view in enlarged scale and in longitudinal section of a control button provided in the iron and in a first operating position in which it controls opening of a solenoid valve located in the machine body and having the function of sending steam to the iron.

FIGS. 4*a* and 4*b* illustrate in detail the operation of the button 7, according to two operating positions, i.e. a first position of FIG. 4*a* in which the solenoid valve 6 of FIG. 1 is controlled to send steam to the iron and a second operating position of FIG. 4*b* in which the pump 27 is operated for collecting water from the supplementary tank 9. Let us suppose that the iron 1 is connected to the machine body 2 of the ironing system, see FIG. 1, i.e. that the plug 15 for connection of the electrical cable 14 and of the steam tube 13 is connected to the connection socket 16 located on an outer wall of the machine body 2 and that the connection plug 17 located on an outer wall of the machine body 2 is connected to the related connection socket 18 of the electrical cable 19 and that the plug 20 of this latter is connected to a normal electrical power socket. In this way, the various electrical connections are established between iron 1 and machine body 2 and the steam tube 13 communicates with the portion of steam tube 13*a*. When the ironing system is switched on, the boiler 10 starts to produce steam, which will be sent to the iron 1 only when the solenoid valve 6 is controlled to open. Returning to FIG. 4*a*, when the user holding the iron presses the arm 107 a first time, due to the pin 29 the button 7 rotates so that the appendage 307 moves away from the switch 28, and therefore the actuator 128 is released and takes this switch 28 to the closed position. Simultaneously, the arm 207 of the button 7 is taken into contact with the rod 26 of the pump 27. By means of this first pressure of the button 7 and closing of the switch 28, the solenoid valve 6 of FIG. 1 receives the signal to send steam to the iron 1 through the tube 13. The steam passes through this tube, through the check valve 21, see FIG. 2, reaches the cavities 104 of the chamber 4 and from here passes to the soleplate 3 and is emitted through the holes 103. The soleplate 3 is naturally heated by means of the electrical resistor 33 which in this moment is electrically supplied through the cable 14. If the user wishes to send a further quantity of steam to the soleplate, so as to obtain a "steam boost", he or she presses the arm 107 of the button 7 again, see FIG. 4*b*, so that this latter rotates further and enables the arm 207 to press the rod 26 completely, so that the piston 50 of FIG. 3 is taken close to the bottom of the cylinder 45. By slightly releasing the arm 107 of the button 7, this latter will return to the position of FIG. 4*a* and a certain quantity of water will be collected from the supplementary tank 9 by means of the pump 27. The water collected passes through the duct 31, the inlet hole 46 of the pump, enters the cylinder 45, exits from the hole 47 and, through the delivery duct 32, then reaches the cavities 104 of the chamber 4 where it is vaporised and passes through the holes 103 of the soleplate 3. In substance, emission of steam that is independent from the flow of steam coming from the machine body 2 is obtained.

The button 5 for operating the pump 38 of FIG. 3 enables a further flow of water to be obtained to send to the sprayer 8, from which the nebulised water is emitted. The pump 38 operates analogously to the pump 27 described above. When the user wishes to obtain a spray of nebulised water from the sprayer 8, he or she presses the button 5; this pressure causes a downward translation of the arm 305 and consequently also a downward translation of the piston 37 connected to the rod 36, against the action of the spring 44. When the button 5 is released the piston 37 returns upwards due to the action of the spring 44 and a certain quantity of water is collected from the tank 9 through the duct 41 communicating with the tank 9, through the inlet hole 40 in the cylinder 39, is emitted from the hole 42 and is sent to the sprayer 8 through the delivery duct 43.

Moreover, by means of the duct 22 of FIG. 1, besides the "steam boost" described above, it is also possible to send a flow of water from the tank 9 to the soleplate 3 of the iron when the user opens the valve 23, which will be connected to a related control button located on the box body 101 of the iron. This duct 22 is provided with the check valve 24, which can be similar to the seal valve 21 illustrated in FIG. 2. The steam generated in this was by the sole place 3 heated by the electrical resistor 33 has a constant flow, different from the "steam boost" described above and generated by means of the button 7. This constant flow of steam from the duct 22 can replace the main flow of steam coming from the tube 13 and consequently from the machine body 2.

Therefore, advantageously the ironing system provided with the iron described above can be used in many ways. A first operating mode enables a greater quantity of steam to be obtained when required, due to the use of the supplementary tank 9 located inside or above the box body 101 of the iron 1. This greater quantity of steam can be obtained by means of the button 5 which, as seen, enables the supplementary "steam boost" to be obtained in the second operating position thereof of FIG. 4*b*, and/or by operation of the valve 23, which enables the water contained in this tank 9 to be supplied directly through the duct 22. In addition, if the machine body is made separable from the iron and the iron is connected to an electrical connection socket, the iron of the present ironing system can advantageously also be used on its own.

What is claimed is:

1. Ironing system comprising a machine body provided with means for producing and supplying steam and an iron comprising a heated soleplate and connected to said machine body by means of a tube for the passage of steam and an electrical cable, characterized in that said iron comprises a supplementary water tank suitable to supply water to said heated soleplate and at least one control button suitable to cooperate with a switch for operating means for producing and supplying steam from the machine body and with means for pumping water from said supplementary tank to said heated soleplate, there being operated, in a first active position of said button, said means for producing and supplying the steam from said machine body and, in a second active position of said button said pumping means so as to obtain a further production of steam by means of the passage of said water from said supplementary tank to said heated soleplate.

2. Ironing system according to claim 1, characterised in that said button is positioned around a rotation pin and comprises a rotating appendage suitable to cooperate with a switch for starting said means for producing and supplying steam from the machine body.

3. Ironing system according to claim 1, characterised in that said button comprises a rotating arm suitable to cooperate, in said second active position, with a moving element of pumping means.

4. Ironing system according to claim 1, characterised in that said iron comprises a further button suitable to cooperate with further pumping means communicating with said supplementary tank, said pumping means being connected upstream with a duct for collecting water from said tank and downstream with a duct for sending water to a sprayer positioned on the box body of the iron.

5. Ironing system according to claim 4, characterised in that said second button laterally comprises an arm connected with a moving element of said pumping means for collecting water from the supplementary tank.

6. Ironing system according to claim 5, characterised in that said second button comprises a fixed shaft on which there is fitted a moving tubular element, said moving tubular element being connected to said arm and maintained in inactive position by means of elastic return means.

7. Ironing system according to claim 1, characterised in that said supplementary tank comprises a duct for filling with water obtained in the box body of the iron.

8. Ironing system according to claim 1, characterised in that said supplementary tank downstream comprises a duct for the direct supply of water towards the heated soleplate.

9. Ironing system according to claim 8, characterised in that in said duct there is positioned a check valve, upstream of which there is positioned a valve for the supply of water from said tank.

* * * * *